US006497571B1

(12) United States Patent
McAlonan et al.

(10) Patent No.: US 6,497,571 B1
(45) Date of Patent: Dec. 24, 2002

(54) DURABLE CATALYTIC BURNER SYSTEM

(75) Inventors: Malachy McAlonan, Finksburg, MD (US); Russell N. Bennett, Baltimore, MD (US)

(73) Assignee: Teledyne Energy Systems, a division of Teledyne, Hunt Valley, MD (US)

( * ) Notice: Subject to any disclaimer, the term of this patent is extended or adjusted under 35 U.S.C. 154(b) by 68 days.

(21) Appl. No.: 09/838,233

(22) Filed: Apr. 20, 2001

(51) Int. Cl.[7] ..... F23D 14/18

(52) U.S. Cl. ..... 431/328; 431/170; 431/7; 431/268

(58) Field of Search ..... 431/328, 326, 431/329, 170, 7, 268, 116, 9; 60/750; 422/171, 177, 122, 143, 211; 126/92 AL

(56) References Cited

U.S. PATENT DOCUMENTS

| | | | | |
|---|---|---|---|---|
| 3,627,588 | A | 12/1971 | Rubinstein et al. | 136/205 |
| 3,881,962 | A | 5/1975 | Rubinstein | 136/209 |
| 4,047,876 | A | 9/1977 | Rice | 431/7 |
| 4,189,294 | A | 2/1980 | Rice et al. | 431/7 |
| 4,235,588 | A | 11/1980 | Tanaka | 431/268 |
| 4,292,274 | A | 9/1981 | Faitani et al. | 422/197 |
| 4,294,225 | A | 10/1981 | Mayo | 126/204 |
| 4,692,306 | A | 9/1987 | Minet et al. | 422/49 |
| 4,726,767 | A | 2/1988 | Nakajima | 432/222 |
| 4,767,467 | A | 8/1988 | Holland et al. | 136/217 |
| 4,911,143 | A | 3/1990 | Pivot et al. | 126/414 |
| 5,009,592 | A | 4/1991 | Roldan et al. | 432/222 |
| 5,161,964 | A | 11/1992 | Frigiere et al. | 431/268 |
| 5,251,609 | A | 10/1993 | Thibault et al. | 431/328 |
| 5,571,484 | A | 11/1996 | Pettit et al. | 422/177 |
| 5,753,383 | A | 5/1998 | Cargnelli et al. | 429/13 |
| 5,842,851 | A | 12/1998 | Pivot | 431/328 |
| 5,917,144 | A | 6/1999 | Miyake et al. | 136/205 |
| 5,921,769 | A | 7/1999 | Lorek | 431/328 |
| 5,968,456 | A | 10/1999 | Parise | 422/177 |
| 5,993,192 | A | 11/1999 | Schmidt et al. | 431/7 |

*Primary Examiner*—Henry Bennett
*Assistant Examiner*—Josiah C. Cocks
(74) *Attorney, Agent, or Firm*—Rosenberg, Klein & Lee

(57) ABSTRACT

There is provided a flameless catalytic burner system employing a catalytic bed assembly (20) for catalyzing the oxidation of a fuel stream. The catalytic bed assembly (20) includes first and second retaining members (122, 124) which define a compartment therebetween. The catalytic bed assembly (120) also includes a plurality of catalytic members (126) disposed within the compartment. The first retaining member (122) is formed with an upstream face portion (1220) transversely extending relative to the fuel stream to describe a convex peripheral contour about at least a portion of the compartment. The second retaining member (124) is formed with a downstream face portion (1240) transversely extending relative to the fuel stream to describe a concave peripheral contour about at least a portion of the compartment. The upstream face portion (1220) is greater in surface area than the downstream face portion (1240).

20 Claims, 3 Drawing Sheets

DURABLE CATALYTIC BURNER SYSTEM

BACKGROUND OF THE INVENTION

1. Field of the Invention

The subject durable catalytic burner system is generally directed to a system for combustively oxidizing an inflowing mixture of fuel and air (referred to herein simply as a fuel stream) to generate heat. More specifically, the subject durable catalytic burner system incorporates a catalytic bed assembly which, at its steady state, operates in a flameless catalytic mode to effect heat-releasing oxidation reactions of the fuel stream. The subject durable catalytic burner system incorporates a combination of mechanical features which collectively yield thermodynamic efficiencies that afford the catalytic bed assembly a longer operational life.

There is a need in numerous applications for burner systems that are operable for extended periods of continuous use. In electric power generator systems located at remote, unmanned stations, for example, burner systems are employed which reactively consume an inflowing stream of fuel to generate heat that, then, is thermoelectrically converted to electric power. Typically, the burner system is mounted directly to a thermoelectric conversion unit for this purpose. The heat generated by the burner system's operation is transferred through its heat exchanger portion to the thermoelectric conversion unit for appropriate transduction.

Catalytic burner systems are often employed in these and other such applications for the thermodynamic advantages inherent to their steady state operation. A conventional catalytic burner system 1 known and typically used in the prior art is shown in FIGS. 5 and 6. System 1 includes a housing 10 in which a burner chamber 12 is formed. In the walls surrounding this chamber 12 are an upstream opening 14 and a downstream opening 16. A fuel supply stream is introduced to and exhausted from chamber 12 through these openings 14, 16 as indicated by the directional arrows 15. Housing 10 is formed of a metallic or other suitable material such that the walls and floor defining burner chamber 12 serve collectively as a heat exchanger that effectively transfers the heat generated within chamber 12 to a thermoelectric conversion or other such unit mounted therebeneath.

Disposed within chamber 12 is a catalytic bed assembly 20 that, upon sufficient initial heating, catalyzes oxidation of the fuel/fair mixture constituting the introduced stream of fuel to sustain a level of generated heat. The assembly—which is supported in part by a plurality of heat conductive posts 18 projecting upward from the floor of burner chamber 12—includes upstream and downstream mesh retaining members 22, 24. Mesh retaining members 22, 24 serve as fuel-pervious retaining wall structures between which a bed of catalytic bead members 26 are retained.

While not shown, a cover is typically installed directly over chamber 12. Such cover is coupled to housing 10, so as to fit tightly against catalytic bed assembly 20 and thereby prevent the incoming fuel stream from bypassing that catalytic bed assembly 20.

Briefly, operation of system 1 occurs as follows. As the fuel stream traverses catalytic bed assembly 20, it is initially ignited within that chamber 12, downstream of catalytic bed assembly 20. As the resulting flame burns within chamber 12, the individual catalytic bead members 26 are gradually heated until enough of them attain a sufficient temperature to catalyze a flameless oxidation reaction o f at least a portion of the fuel stream. Enough of the fuel in the stream is eventually consumed in this manner that an insufficient concentration of fuel remains to sustain the flame combustion. The initially ignited flame thus extinguishes, and flameless catalytic combustion prevails, whereby the catalytic bead members 26 are maintained in their sufficiently heated state by heat released from the ongoing catalyzed oxidation reactions. The region of most intense oxidation—thus, of most intense heat production—then propagates upstream through catalytic bed assembly 20 until the upstream-most layer of catalytic bead members 26 come to oxidize much of the fuel in the passing fuel stream.

While adequate for basic operation, such prior art catalytic burner systems are encumbered by a number of shortcomings. First, its mechanical features permit the premature degradation of catalytic bead members 26, permitting in turn the premature degradation of the burner system's thermodynamic efficiency. Each type of catalyst composition (typically, coated onto the surface of a ceramic or other suitable substrate to form catalytic bead members 26) that may be employed for catalytic bed 20 is characterized by a range of temperatures at which it serves its catalyzing function in stable manner. At temperatures above this range, a given catalyst composition becomes unstable and sustains a measurable damage if maintained at the excessive temperatures. Even within its range of temperatures, a catalyst composition's ultimate durability is closely correlated with the temperatures at which it is maintained during burner operation. Generally, the lower the temperature at which a catalyst composition is maintained during operation, the longer its useful life. Conversely, the higher the temperature at which a catalyst composition is maintained during operation, the quicker it degrades. Particularly in applications requiring extended periods of burner operation, therefore, it becomes important to minimize the catalyst composition's operating temperature within the permissible range. Adequate measures to so minimize the catalyst composition's temperature are not provided in catalytic burner systems heretofore known utilized as sources of heat.

The sectional or transverse area of the catalyst bed's upstream side, or 'face' is found to be an important factor in this context. An increase in the transverse area yields a corresponding increase in the spatial distribution of the total heat produced by the catalyzed reaction. Increasing the transverse area consequently affords a lower operating temperature for each individual catalyst bead member within a catalytic bed. Moreover, as it is the upstream-most transverse layer of catalytic bead members 26 that first reacts with the stream of fuel impinging thereon, the transverse area at the upstream face of the catalytic bed proves to be of particular importance.

When subjected to substantial periods of normal use, many of the beads 26 forming the bed's upstream-most portions in the prior art burner system 1 are visibly degraded, having lost a substantial proportion of their catalytic capacity. A disproportionately greater degradation is typically revealed in catalytic bead members 26 at the upstream-most regions of the catalytic bed than at the downstream-most regions. In long term operation, the catalytic bed's upstream-most layer degrades in catalytic performance until it becomes inactive, causing the next layer of bead members 26 to become the most active. This continues, in turn, for successive layers of bead members 26, such that the catalytic bed is progressively destroyed from its upstream-most to its downstream-most portions, until its catalytic performance is diminished beyond acceptable levels.

The problem is aggravated where a concentration of flow occurs at the catalytic bed's upstream-most portions. Variations in flow resistance in the bed cause the flow to be more concentrated along certain stream paths through the catalytic bed. Directional arrows 17 and 19 illustrate examples of stream paths potentially of differing flow concentration.

Another shortcoming found in the prior art catalytic burner system 1 is that of inefficient catalytic bed heating during the initial phases of burner operation. The initially ignited flame bears against the downstream face of the catalytic bed to provide the required bed heating. Without measures to intensify the heat of the flame, it is not uncommon in many applications for insufficient heating of the catalytic bed (to enable self-sustaining catalytic mode operation) to occur before the flame is squelched due to diminishing fuel concentration. This disrupts the transition between the flame and catalytic modes of operation, ultimately causing system failure.

It is found using platinum coated alumina beads as the catalyst composition, for example, that maintaining a flame stable enough to ensure proper transition to the catalytic combustion mode of operation necessitates catalyst temperatures in at least a portion of the bed to reach excessive levels. Platinum coated alumina beads are rendered sufficiently active to serve their catalyzing function at approximately 900° F., and are capable of withstanding a maximum temperature of 1200° F. over extended periods of time. Such beads exhibit instability at temperatures exceeding that maximum; yet, the conditions required to maintain a stable flame for the catalytic bed heating are found to produce at certain points in the bed catalyst temperatures reaching approximately 1500° F.

There exists a need, therefore, for a catalytic burner system that is thermodynamically efficient in operation. There also exists a need for such a catalytic burner system wherein premature degradation of the catalytic bed material is avoided, and wherein sufficient transition between flameless and catalytic combustion modes of operation reliably occurs.

2. Prior Art

Burner Systems which employ catalyst members for catalyzing flameless combustion are known in the art. The best prior art known to applicant includes U.S. Pat. Nos.: 5,993,192; 5,968,456; 5,921,769; 5,917,144; 5,842,851; 5,753,383; 5,571,484; 5,251,609; 5,161,964; 5,009,592; 4,911,143; 4,767,467; 4,726,767; 4,692,306; 4,294,225; 4,292,274; 4,235,588; 4,189,294; 4,047,876; 3,881,962; and 3,627,588. Systems disclosed in such prior art, however, fail to disclose the combination of features uniquely incorporated in the subject durable catalytic burner system. There is no catalytic burner system heretofore known which preserves thermodynamic efficiencies in the manner disclosed herein, nor is there any catalytic burner system heretofore known which prevents premature degradation of the catalyst material and reliably effects the transition between flameless and catalytic combustion modes of operation in the manner disclosed herein.

SUMMARY OF THE INVENTION

It is a primary object of the present invention to provide a catalytic burner system which is thermodynamically efficient in operation.

It is another object of the present invention to provide a catalytic burner system wherein premature degradation of the catalytic bed is avoided.

It is yet another object of the present invention to provide a catalytic burner system wherein the transition between flame and catalytic combustion modes of operation occurs reliably.

These and other objects are attained in the subject durable catalytic burner system. The subject durable catalytic burner system incorporates a catalytic bed assembly for catalyzing the oxidation reaction of an introduced stream of fuel. The catalytic bed assembly generally comprises first and second retaining members which are pervious to the fuel stream, and which define a compartment therebetween. The catalytic bed assembly also comprises a plurality of catalytic members disposed within the compartment for catalyzing flameless combustion of the fuel stream to generate heat. The first retaining member includes an upstream face portion transversely extended relative to the fuel stream to describe a convex peripheral contour about at least a portion of the compartment. The second retaining member includes a downstream face portion transversely extending relative to the fuel stream to describe a concave peripheral contour about at least a portion of the compartment. The upstream face portion is greater in surface area than the downstream face portion.

The reduction in cross-sectional area from the upstream-most to the downstream-most portions of the catalytic bed's retaining members serves to concentrate the combustion process during the initial stages of system operation while the fuel concentration remaining in the fuel stream concurrently is decreasing. During steady state operation, the flow concentration mitigates the reduction in catalytic oxidation from lower fuel concentration, decreasing the temperature gradient from the upstream-most to the downstream-most portions of the catalytic bed. The resulting system yields enhanced combustion in the downstream portions of the catalytic bed, and thereby increases thermodynamic efficiency.

In a preferred embodiment, at least a portion of each upstream and downstream face portion describes along at least one planar dimension a cylindrically arced contour. The first and second retaining members in that embodiment are spaced at their cylindrically arced portions by a substantially uniform radial spacing, whereby a catalytic bed having a substantially uniform thickness is formed thereat. The uniformity in bed thickness provides uniformity in resistance to the fuel stream's flow therethrough, which in turn provides uniformity in temperature within a layer of catalytic bead members transverse to the flow direction.

DETAILED DESCRIPTION OF THE PREFERRED EMBODIMENTS

Figure 1:
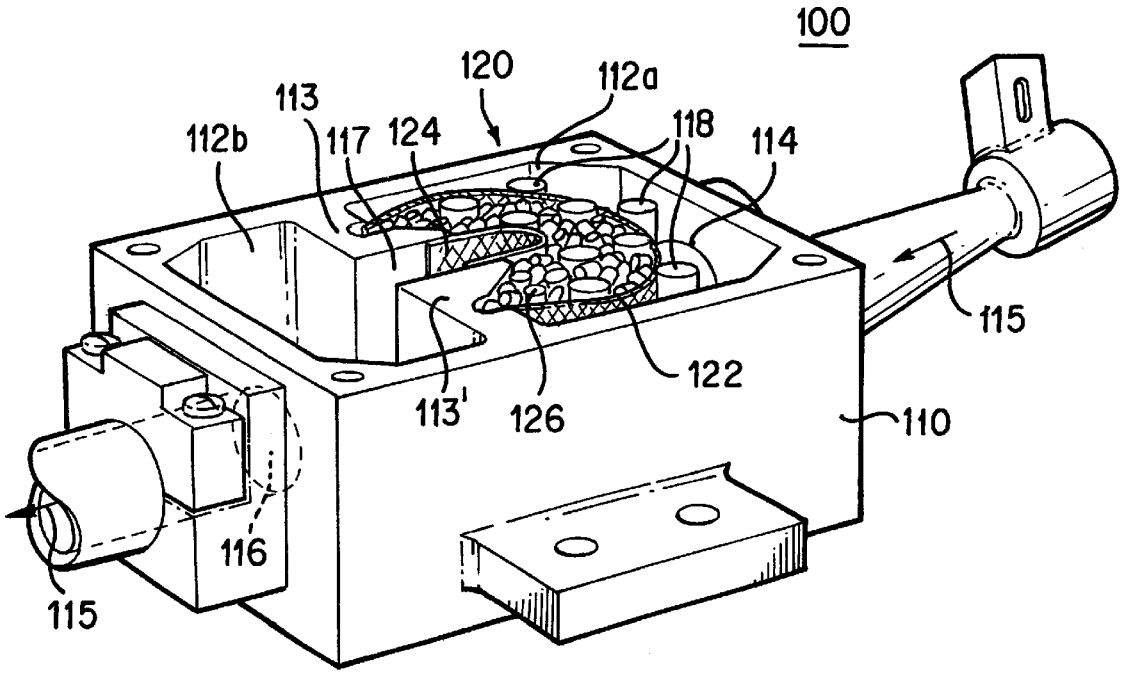
FIG. 1 is a perspective view, partially cut-away, of a preferred embodiment of the present invention.
Figure 2:
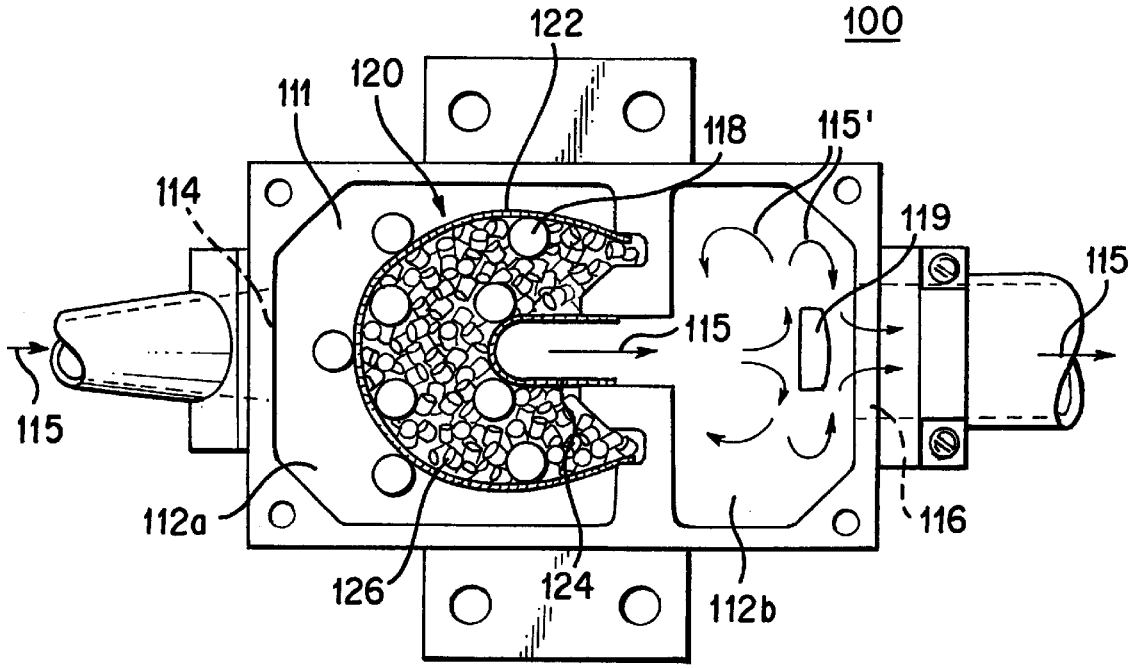
FIG. 2 is a plan view of one portion of the embodiment of the present invention shown in FIG. 1.

Referring now to FIGS. 1–2, there is shown one preferred embodiment of the subject durable catalytic burner system 100. System 100 generally includes a housing 110 defining at least one burner chamber in which a catalytic bed assembly 120 formed in accordance with the present invention is disposed. Housing 110 is formed of a metallic or other material known in the art having the properties suitable to withstand the extreme conditions to be encountered in the intended burner application, while catalytic bed assembly 120 is formed with a bed of platinum, palladium, or any other noble metal or other catalyst material suitable for the intended application. While the catalyst material(s) selected may wholly constitute the catalytic members employed, the catalyst material is preferably coated onto the surfaces of members formed of alumina or any other suitable substrate material known in the art.

Not shown is a cover for housing 110. Such cover is coupled to housing 110 so as to engage both the housing's walls and catalytic bed assembly 120 in gas tight sealed manner. This ensures that the fuel stream entering chamber 112*a* flows through, not around, catalytic bed assembly 120.

Housing 110 is preferably configured as shown having defined therein an upstream chamber 112*a* and a downstream chamber 112*b* partitioned by a pair of dividing members 113, 113' extending laterally therebetween. Dividing members 113, 113' are formed with respective opposing terminal ends spaced one from the other by a gap 117 that enables communication between upstream and downstream chambers 112*a*, 112*b*. Housing 110 has formed at its upstream wall an opening 114 for passing a fuel stream (containing the appropriate fuel/air mixture) into upstream chamber 112*a* as indicated by the directional arrows 115. Housing 110 also has formed at its downstream wall an opening 116 for exhausting the residual fuel stream upon passage through downstream chamber 112*b*.

Housing 110 is formed with a bottom surface 111 underlying chambers 112*a*, 112*b*. Projecting from bottom surface 111 into upstream chamber 112*a* are a plurality of thermal conduction posts 118 spaced one from the others in a predetermined arrangement. Such thermal conduction posts 118 serve a number of functions. First, they serve to contact catalytic bed assembly 120, and thereby convey the heat generated therein to bottom surface 111 which, in turn, serves as a heat exchanger to a thermoelectric conversion or other unit mounted therebeneath (not shown). Posts 118 also serve a structural reinforcement function by retentively supporting those parts of catalytic bed assembly 120 bearing thereagainst.

Also projecting from bottom surface 111, but into downstream chamber 112*b* is a deflection member 119 disposed as shown adjacent downstream opening 116. Deflection member 119 serves to block and thereby deflect the residual exhaust stream resulting from the inflowing fuel stream's impingement upon and passage through catalytic bed assembly 120. As indicated by the directional arrows 115', this deflection creates a turbulent, recirculating flow of the exhaust stream within downstream chamber 112*b* prior to escape through opening 116. The exhaust stream's prolonged turbulent dwell within downstream chamber 112*b* permits more of the heat to be transferred therefrom to the surrounding wall and floor surfaces, as well as to deflection member 119, for conduction to the given unit being heated.

Preferably, catalytic bed assembly 120 is disposed and oriented as shown within upstream chamber 112*a*. Assembly 120 includes a first retaining member 122 defining the assembly's upstream periphery and a second retaining member 124 defining the assembly's downstream periphery. Each retaining member 122, 124 extends transversely relative to the stream of fuel which enters upstream chamber 112*a* through opening 114. That is, each retaining member 122, 124 is oriented such that the impinging stream of fuel passes transversely through its planar extent. First and second retaining members 122, 124 are spaced from one another to define a substantially U-shaped compartment wherein a plurality of catalytic bead members 126 are disposed to form a catalytic bed. Catalytic bead members 126 may be of any suitable material composition known in the art, but is preferably selected in the embodiment shown from known noble metal catalyst materials deposited on a ceramic substrate. The actual choice of catalyst material depends upon the specific requirements of the intended application, and is not important to the present invention.

Each retaining member 122, 124 is preferably formed with a metallic mesh configuration, each being deflectable to attain the respective configurations shown. Each retaining member 122, 124 is pervious to the fuel/exhaust stream, but impervious to the individual catalytic bead members 126.

Figure 3:
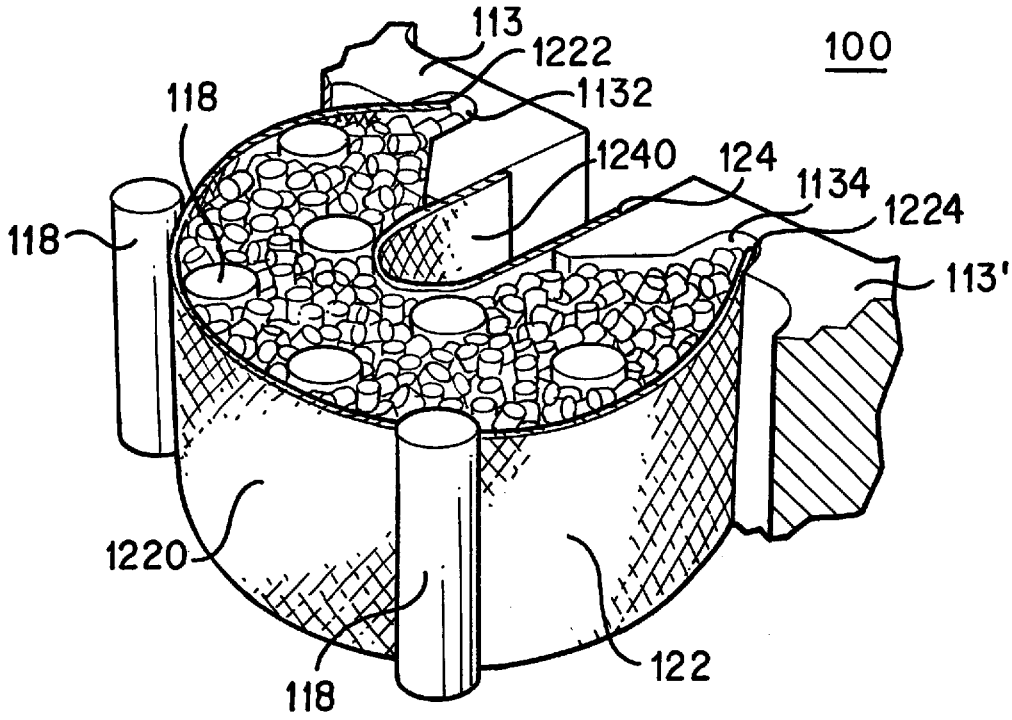
FIG. 3 is a perspective view of another portion of the embodiment of the present invention shown in FIG. 1.
Figure 4:
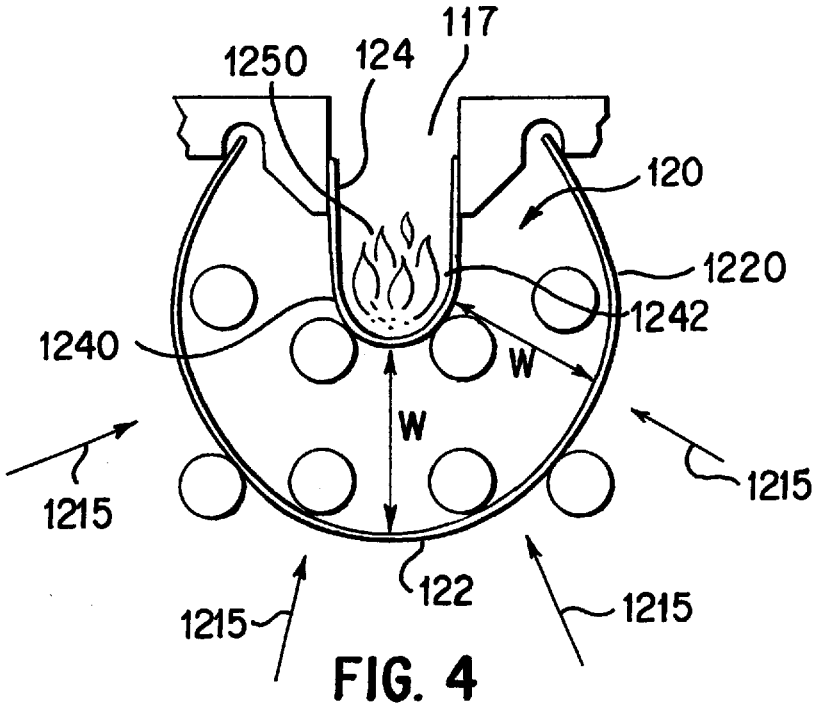
FIG. 4 is a schematic plan view of the portion shown in FIG. 3.
Figure 5:
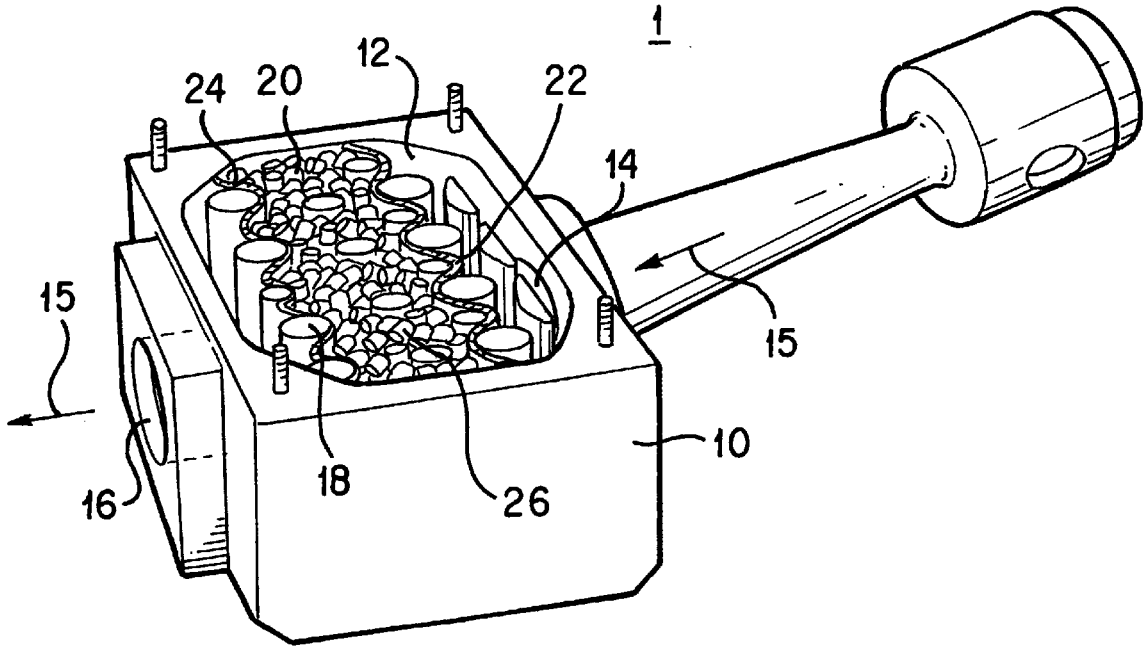
FIG. 5 (PRIOR ART)
FIG. 5 is a perspective view of a burner system known in the art.
Figure 6:
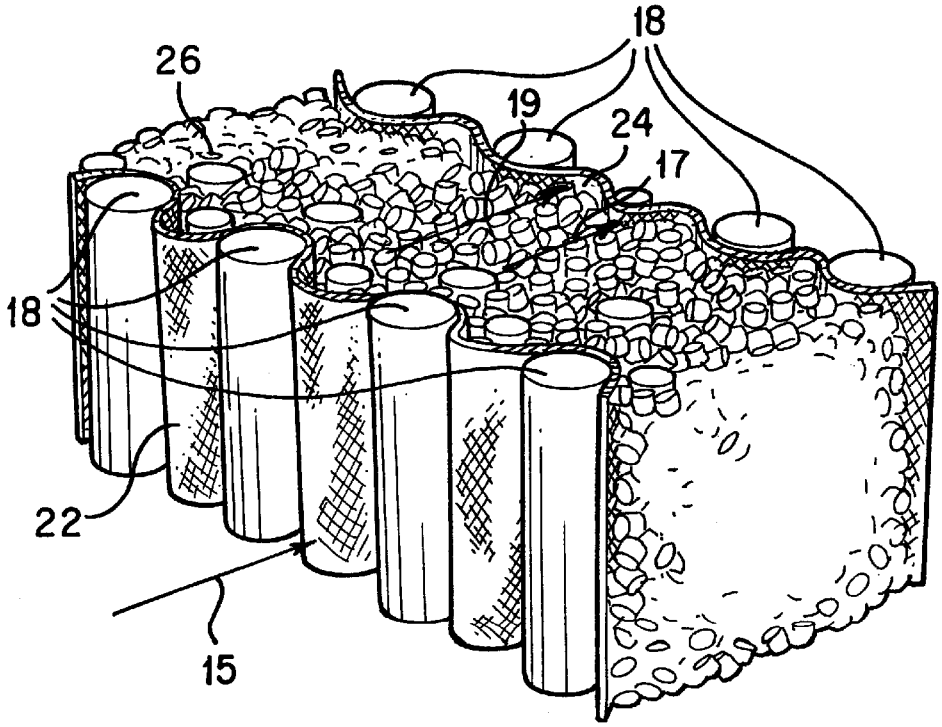
FIG. 6 (PRIOR ART)
FIG. 6 is a perspective view of a portion of the prior art burner system shown in FIG. 5.

Referring to FIGS. 3–4, first retaining member 122 forms an upstream face portion 1220 that extends transversely relative to the fuel stream to describe a convex peripheral contour about the catalytic bead compartment. Preferably, this upstream face portion 1220 defines along at least one planar dimension a cylindrically arced contour as it extends from opposed ends 1222, 1224. Note that where the available resources and system requirements so permit, upstream face portion 1220 may be similarly contoured with a cylindrical arc along more than one planar dimension. Upstream face portion 1220 in such cases may, for example, be cylindrically contoured along not only a horizontal plane, but along a vertical plane.

Second retaining member 124 includes a downstream face portion 1240 that extends transversely relative to the fuel stream to describe a concave peripheral contour about at least a portion of the catalytic bead compartment. Downstream face portion 1240 of this second retaining member 124 also describes a cylindrically arced contour along at least one planar dimension. The cylindrical arc described by downstream face portion 1240 correlates to that described by upstream face portion 1220 of first retaining member 122 in such manner that the radial width w of the catalytic bead compartment between the retaining members' cylindrically arced regions remains substantially uniform. Hence, the catalytic bed thickness, at least at those regions, remains substantially uniform.

This affords a number of advantages. First, it promotes quick and uniform heating of the catalytic bed during the system's flame combustion phase of operation. As described in more detail in following paragraphs, the catalytic bed's heating is initiated by forming an intense flame 1250 within the confined cupped region 1242 defined by the second retaining member's downstream face portion 1240. The heat radiating omni-directionally from that point may then evenly effect a gradual heating radially outward from those portions of the bed closest to second retaining member 124 towards those portions closest to first retaining member 122.

The substantially uniform bed thickness affords another, perhaps more significant, advantage in that it permits the catalytic bed to offer a substantially uniform resistance to the fuel stream passing through upstream chamber 112*a*. This contributes to a lower thermal gradient within the catalytic bed during steady state operation. As indicated by the directional arrows 1215, the fuel stream introduced from the upstream side of catalytic bed assembly 120 would flow radially inward through the bed's thickness before exhausting through gap 117, into downstream chamber 112*b*. The substantial uniformity of the bed's thickness yields an even flow rate throughout a substantial portion of the bed, preventing regions of higher catalytic bead temperature that might otherwise result from the flow rate being unevenly higher at some than others.

In accordance with the present invention, the upstream transverse face area of catalytic bed assembly 120 is maximized to practicable limits (for instance, to the extent possible while maintaining the temperature of the upstream-most catalytic bead member layer at a level sufficient to sustain the catalytic combustion) by configuring the upstream bead retaining member 122 in the cylindrically arced manner shown. Retaining member 122 may be contoured differently in other embodiments so long as it is contoured in light of the pertinent considerations disclosed herein, to maximize the bed assembly's transversal upstream surface area. Maximizing the area of this upstream face 1220 maximizes the distribution of heat generated in the bed's catalyst members at that upstream face during catalytic combustion. This in turn, minimizes the temperature at which each constituent catalytic bead member must operate at to prevent the unstable operation and premature catalyst degradation that might otherwise occur if the catalytic bead members were operated at higher temperatures.

Maximizing the catalytic bed's upstream surface area while cylindrically contouring the catalytic bed substantially to a U-shape serves to lower the bed's thermal gradient during steady state operation. This not only permits the upstream—most catalytic bead members 126 to operate at lower temperatures than in prior art burner systems, it lowers the catalytic bed's requisite thickness at any given portion thereof (in correlation to the greater spatial distribution of the catalytic combustion reaction.)

In accordance with the present invention, the transverse downstream face of catalytic bed assembly 120 is configured to correspond in contour to the assembly's transverse upstream face. Accordingly, second retaining member 124 which defines this transverse downstream face portion 1240, is formed in the embodiment shown with a substantially U-shaped contour describing a cylindrically arced intermediate portion. The cylindrically arced intermediate portion extends into a retaining space circumscribed by first retaining member 122 to define for the resulting catalytic bed a peripheral concavity. The cylindrically arced intermediate portion defines immediately downstream of the resulting catalytic bed a cupped region 1242 to accommodate an intense heating flame 1250 during the flame combustion phase of system operation.

The heat generated by the flame 1250 at that cupped region 1242 is intensified by the combined reflection and radiation of the surrounding catalytic bed and housing 110 surfaces. The intense heat is then concentrated at the downstream face portion 1240 surrounding this cupped region 1242. The downstream-most portions of the catalytic bed surrounding much of the flame 1250 directly capture much of the heat generated by the flame. An efficient transfer of heat to the catalytic bed thus results, leading in turn to a quicker and more reliable transition from the flame combustion to the catalytic combustion phases of operation.

While each of the first and second retaining members 122, 124 is formed with a metallic mesh configuration in the embodiment shown, any other suitable configuration known in the art may be employed. Given that the catalyzing effect of the catalytic bed is optimized by increased catalyst surface area, the catalytic bed is formed by a plurality of constituent bead members of suitable geometric properties. Retaining members 122, 124 contain the bead members in the given bed configuration. It is important that first and second retaining members 122, 124 be sufficiently pervious to the given fuel/exhaust stream, and that they be of such material properties to withstand for extended periods of time the environmental extremes encountered in a catalytic burner system.

As shown in FIG. 3, first retaining, or screen mesh, member 122 is installed as shown within upstream chamber 112*a* for, among other things, from preventing the flame combustion from propagating further upstream during the initial stages of system operation. First retaining member 122 is installed by engaging one end 1222 along an engagement groove 1132 formed in one dividing member 113 and engaging a second end 1224 along another engagement groove 1134 formed in the other dividing member 113'. The intermediate portion of first retaining member 122 is routed between suitably positioned thermal conduction posts 118 such that it describes for the catalytic bed the convex upstream peripheral contour shown. Preferably, the natural bias of retaining member 122 towards its undeflected configuration enables it to be self-retained in this deflected configuration, forcibly bearing against the various engaging portions of housing 110.

Similarly, second retaining member 124 is self-retained as shown with its ends captured between the terminal end portions of the opposed dividing members 113, 113'. Preferably, its natural bias towards an undeflected configuration serves to maintain second retaining member 124 in the deflected configuration shown.

Both the upstream and downstream retaining members 122, 124 may be configured as a screen mesh formed of a stainless steel or other high temperature, oxidation resistant material. First retaining member 122 is preferably so formed having a mesh size small enough not only to retain catalytic bead members 126, but to also prevent propagation of a flame upstream of the catalyst bed. When using natural gas as a fuel, the preferable mesh size is 20×20 wires per inch made with 0.016 inch diameter wire. The downstream, second retaining member 124 is preferably formed having openings as large as the size of bead members 126 will permit—that is, having openings sufficiently dimensioned to prevent the escape of individual catalytic bead members 126 therethrough. It is preferable that this material not quench a flame.

Allowing the flame to contact the catalyst bed during system startup improves the heat transfer between the flame and the catalytic bed. When using catalytic pellets, or bead members, 126 consisting approximately of ⅛ inch diameter by ⅛ inch long alumina cylinders coated with platinum, a mesh size of 8×8 wires per inch made with 0.028 inch diameter wire proves acceptable.

In typical operation, a stream of fuel appropriately mixed with air is generated to flow through upstream and downstream chambers 112*a*, 112*b* of housing 110, following the paths indicated by directional arrows 115, 115'. An igniter positioned within downstream chamber 112*b*, but well offset laterally from the central path 115 of the stream's flow, is then actuated to ignite the flowing fuel/air mixture. This generates a flame in downstream chamber 112*b* that then propagates upstream through gap 117 to the cupped region 1242. The flame 1250 burns rather intensely at that point, heating catalytic bed assembly 120. As the catalytic bed's constituent catalytic bead members 126 heat to a sufficient temperature, they begin to catalyze a flameless oxidation reaction of the flowing fuel/air mixture which releases heat for further heating of the constituent catalytic bead members 126. As more of the constituent bead members 126 begin to catalyze such flameless oxidation, enough of the fuel is consumed by the catalyzed oxidation reaction that the flame 1250 cannot be sustained. At that point, the flame 1250 is extinguished, and the catalytic combustion phase of operation prevails.

Catalytic bed assembly 120 is formed in accordance with the present invention to insure that sufficient heating of the catalytic bed occurs by then to perpetuate the catalytic combustion phase of operation in self-sustaining manner. Assembly 120 is also formed in accordance with the present invention to insure for the given application that the catalytic bed's constituent catalytic bead members 126 substantially remain in temperature during this steady state at minimal levels required for stable operation.

The area of the upstream screen, or first retaining member 122, is sized to yield steady state operating temperatures of the upstream-most layer of catalytic bead members 126 somewhere between the lowest temperature at which the catalyzed oxidation reaction is self-sustaining and the highest temperature that the catalyst can withstand without deteriorating in the long term. When a platinum catalyst is used to catalyze the oxidation of natural gas, the range of reliable long term operating temperatures for the upstream-most layer of catalytic bead members 126 is very narrow, extending from approximately 1100° F. to 1200° F.

The area of the upstream retaining member 122 is, therefore, a function of the type of fuel, flow rate, catalyst material, and temperature of the fuel stream. As an example, for a burner with the heat transfer arrangement shown in FIG. 2, and a flow rate of 60 cubic inches/minute of natural gas entering housing 110 at approximately 150° F., an upstream face portion area of 8.8 square inches for first retaining member 122 retaining a bed of platinum coated alumina catalyst yields an upstream-most catalyst temperature range of 1150–1200° F.

The area of the downstream, or second, retaining member 124 preferably falls within the range determined on the low end by the maximum velocity the fuel stream can possess as it passes through gap 117, and on the high end by the need for an energetic flame within cupped region 1240. If the fuel stream velocity through gap 117 exceeds the flame propagation velocity of the fuel air mixture, the flame in downstream chamber 112*b* will not be able to propagate back to the cupped region 1240. The propagation velocity, for example, of a methane air mixture at room temperature is approximately 1.5 feet/sec. The upper limit on the area is reached when the flame within cupped region 1240 spreads over such a large area that it is quenched and dies as it contacts second retaining member 124. For the example of a burner subjected to a flow rate of 60 cubic inches/minute of natural gas, the total flow rate of natural gas and air reaches approximately 700 cubic inches/minute. A downstream retaining member 124 area of 2.5 square inches with a gap 117 cross-sectional area of 0.8 square inches then yields a gas stream velocity through gap 117 of 1.2 feet/second. This produces a highly energetic flame within cupped region 1240.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, and certain features may be used independently of other features, all without departing from the spirit or scope of the invention as defined in the appended Claims.

What is claimed is:

1. A catalytic bed assembly for catalyzing an oxidation reaction of a fuel stream in a burner comprising:

(a) first and second retaining members pervious to the fuel stream and defining a compartment therebetween, said first retaining member having an upstream face portion transversely extended relative to the fuel stream to describe a convex peripheral contour about at least a portion of said compartment, said second retaining member having a downstream face portion transversely extended relative to the fuel stream to describe a concave peripheral contour about at least a portion of said compartment, said upstream face portion being greater in surface area than said downstream face portion; and, (b) a plurality of catalytic members disposed within said compartment for catalyzing a flameless oxidation of the fuel stream to generate heat.

2. The catalytic bed assembly as recited in claim 1 wherein at least a portion of each said upstream and downstream face portion describes along at least one planar dimension a cylindrically arced contour.

3. The catalytic bed assembly as recited in claim 2 wherein said first and second retaining members are spaced one from the other at said cylindrically arced portions thereof by a substantially uniform radial spacing, whereby a catalytic bed having a substantially uniform thickness is formed thereat.

4. The catalytic bed assembly as recited in claim 2 wherein said compartment is defined by said first and second retaining members to be substantially U-shaped.

5. The catalytic bed assembly as recited in claim 1 wherein said upstream and downstream faces are each formed of a mesh material impervious to said catalytic members.

6. A catalytic bed assembly for catalyzing an oxidation reaction of a fuel stream in a burner comprising:

(a) first and second retaining members pervious to the fuel stream, at least a portion of said first retaining member extending transversely relative to the fuel stream to form a substantially U-shaped contour describing a retaining space, at least a portion of said second retaining member extending transversely relative to the fuel stream to form a substantially U-shaped contour describing a cupped region disposed at least partially within said retaining space described by said first retaining member, whereby a compartment is defined between said first and second retaining members;

said first and second retaining members respectively including upstream and downstream face portions, said upstream face portion being greater in surface area than said downstream face portion; and, (b) a plurality of catalytic bead members disposed within said compartment for catalytically reacting with the fuel stream to generate heat.

7. The catalytic bed assembly as recited in claim 6 wherein said upstream and downstream faces are each formed of a mesh material impervious to said catalytic bead members.

8. The catalytic bed assembly as recited in claim 7 wherein at least a portion of each said upstream and downstream face portion describes along at least one planar dimension a cylindrically arced contour.

9. The catalytic bed assembly as recited in claim 8 wherein said compartment is defined between said cylindrically arced portions of said first and second retaining members to have a substantially U-shaped contour.

10. The catalytic bed assembly as recited in claim 9 wherein said compartment is defined between said cylindrically arced portions of said first and second retaining members to have a substantially uniform radial width.

11. A flameless catalytic burner system comprising:

(a) a housing including a thermally conductive heating surface, said housing defining upstream and downstream chambers disposed adjacent said heating surface, said housing having formed therein an upstream opening communicating with said upstream chamber for passing an inflow of a fuel stream and a downstream opening communicating with said downstream chamber for passing an outflow of an exhaust stream; and, (b) a catalytic bed assembly disposed in said housing to communicate with said upstream and downstream chambers for catalyzing an oxidation reaction of said fuel stream to produce heat and said exhaust stream, said catalytic bed assembly including:

(1) first and second retaining members pervious to said fuel stream and defining a compartment therebetween, said first retaining member having an upstream face portion transversely extended relative to said fuel stream to describe a convex peripheral contour about at least a portion of said compartment, said second retaining member having a downstream face portion transversely extended relative to said fuel stream to describe a concave peripheral contour about at least a portion of said compartment, said upstream face portion being greater in surface area than said downstream face portion; and, (2) a plurality of catalytic members disposed within said compartment for catalyzing a flameless oxidation of said fuel stream to generate heat.

12. The flameless burner system as recited in claim 11 wherein said upstream and downstream chambers are delineated by a pair of dividing members extending therebetween, said dividing members having opposing terminal ends spaced one from the other by a gap.

13. The flameless burner system as recited in claim 12 wherein said catalytic bed assembly is disposed in said upstream chamber, each of said first and second retaining members having a pair of end portions respectively engaging said dividing members, said second retaining member being disposed at least partially in said gap between said dividing members.

14. The flameless burner system as recited in claim 12 wherein said housing further includes a plurality of thermal conduction members extending from said heating surface into said upstream chamber, each said thermal conduction member being disposed in contact with said catalytic bed assembly.

15. The flameless burner system as recited in claim 14 wherein said housing further includes in said downstream chamber a deflection member, said deflection member being disposed adjacent said downstream opening for obstructing at least a portion of said exhaust stream for turbulent dispersion within said downstream chamber prior to escape through said downstream opening.

16. The catalytic bed assembly as recited in claim 14 wherein at least a portion of each said upstream and downstream face portion describes along at least one planar dimension a cylindrically arced contour.

17. The flameless burner system as recited in claim 16 wherein said cylindrically arced portion of said first retaining member radially envelops said cylindrically arced portion of said second retaining member.

18. The catalytic bed assembly as recited in claim 17 wherein said first and second retaining members are spaced one from the other at said cylindrically arced portions thereof by a substantially uniform radial spacing, whereby a catalytic bed having a substantially uniform thickness is formed thereat.

19. The catalytic bed assembly as recited in claim 17 wherein said compartment is defined by said first and second retaining members to be substantially U-shaped.

20. The catalytic bed assembly as recited in claim 19 wherein said upstream and downstream faces are each formed of a mesh material impervious to said catalytic members.

* * * * *